United States Patent [19]

Schmitt

[11] Patent Number: 4,480,246

[45] Date of Patent: Oct. 30, 1984

[54] TRIP-FREE MANUAL RESET THERMOSTAT

[75] Inventor: Donald J. Schmitt, Mansfield, Ohio

[73] Assignee: Therm-O-Disc, Incorporated, Mansfield, Ohio

[21] Appl. No.: 435,080

[22] Filed: Oct. 18, 1982

[51] Int. Cl.[3] ..... H01H 37/04

[52] U.S. Cl. ..... 337/348; 337/91

[58] Field of Search ..... 337/91, 56, 72, 348

[56] References Cited

U.S. PATENT DOCUMENTS

| | | | |
|---|---|---|---|
| 2,948,787 | 8/1960 | Frey et al. | 337/91 |
| 3,322,920 | 5/1967 | Morris . | |
| 3,541,488 | 11/1970 | Odson | 337/13 |
| 3,621,434 | 11/1971 | Gerich | 337/348 |
| 3,660,793 | 5/1972 | Them et al. | 337/348 |
| 3,675,178 | 7/1972 | Place | 337/348 |

*Primary Examiner*—Harold Broome

*Attorney, Agent, or Firm*—Pearne, Gordon, Sessions, McCoy, Granger & Tilberry

[57] ABSTRACT

A trip-free manual reset thermostat is disclosed in which a bimetal snap disc is positioned so that one edge portion engages a movable contact support arm and opens the contacts when the disc operates to its operative condition. A manual reset member is operable to apply a force to the center portion of the disc in the direction of contact opening, causing the edge of the disc to engage fixed stops and to thereafter move the disc to its reset position. The resetting force is applied in the same direction as contact opening movement so that the operation of the reset member maintains the contacts in an open condition even when the disc has been pushed through to the reset condition. The manual reset member is, therefore, incapable of causing switch closure.

8 Claims, 6 Drawing Figures

TRIP-FREE MANUAL RESET THERMOSTAT

BACKGROUND OF THE INVENTION

This invention relates generally to manual reset thermostats or the like, and more particularly to a novel and improved trip-free manual reset thermostat.

PRIOR ART

Manual reset devices often employ a bimetal snap disc which is shaped so that once the disc has reached its operating temperature and snapped through to the operating condition, it will remain in the operating condition until it is manually reset. Such discs are usually produced so that the temperature at which they would automatically reset is outside of the range of temperatures expected in the environment in which the device is intended to be used. In such devices, a manual reset mechanism or member is provided which allows the user to apply a force to the disc which causes it to snap back through to the reset condition even though it has not reached the temperature at which it would do so automatically.

Trip-free bimetal disc-operated manual reset thermostats or the like are structured so that the contacts cannot be closed by the operation of the reset member if the bimetal disc has not reached a temperature below the disc operating temperature. Such devices provide an important safety feature, since the operation of the manual reset member cannot cause switch closure if a temperature condition remains which is above the temperature at which the device operates.

Generally in such trip-free devices, the reset member is structured to limit its travel so that the disc can only be pushed through to an intermediate position from which it will snap the remaining distance to the reset condition only if it has reached a temperature below the operating temperature. Further, in such a device, the switch structure has had to be constructed so that the switch contacts remain open even though the disc has been moved a portion of the away through to its reset position. U.S. Pat. No. 3,660,793 discloses a typical manual reset thermostat which is not trip-free. U.S. Pats. Nos. 3,621,434 and 3,675,178 both disclose trip-free manual reset thermostats.

Generally, in order to provide trip-free operation, it has been necessart to produce the device with a very accurate interrelationship between the switch structure, the disc location and shape, and the travel limitation on the reset member. This has drastically increased the manufacturing costs of such trip-free devices. In fact, it has generally been necessary in the past to employ special fitting operations to achieve trip-free operation in a reliable manner.

SUMMARY OF THE INVENTION

In accordance with the present invention, a snap disc manual reset thermostat or the like can be provided for trip-free operation without requiring very close manufacturing tolerances. The structure is arranged so that the operation of the reset members applies a resetting force to the snap disc which is in the switch opening direction. Therefore, the operation of the reset member cannot cause switch closure. Because the resetting force and movement is in the switch opening direction, the movement of the reset member need not be accurately controlled and the structural relationship between the various parts need not be maintained with the accuracy required in the past. Therefore, with this invention, the provision of a trip-free manual reset function does not materially increase the cost of the device.

In the illustrated embodiment, the basic switch and disc structure is similar to the structure of the thermostats illustrated in U.S. Pat. Nos. 3,322,920; 3,541,488; and 3,660,793. All of the foregoing-listed patents are assigned to the assignee of the present invention.

In the illustrated switch, the disc, when operation occurs, engages a projection at its center and at one location along its periphery engages the movable contact of the switch, causing the movable contact to move to the switch-open position. With such structure, snap movement of the disc center in one direction (toward the projection) causes the periphery of the disc to move in the opposite direction and moves the movable contact in such opposite direction to the open position. The center projection against which the disc rests is provided by the manual reset member. When the disc must be reset, the manual reset member is moved in the direction of switch opening and applies a force to the center of the disc, urging it toward its reset condition. Such movement brings the periphery of the disc into engagement with fixed stops so that continued movement of the manual reset member causes the disc to be pushed through to its reset condition. Since such movement, however, is in the direction of switch opening, it cannot cause closure of the switch contacts.

If the disc temperature has dropped below its operating temperature, the disc remains in its reset condition as the reset member is released and the switch closes. On the other hand, if the disc remains above its operating temperature, release of the force applied by the reset member merely allows the disc to snap back to its operative condition, and the switch remains open. Close tolerances need not be maintained with this device, and the manufacturing costs of providing the trip-free operation are minimal.

These and other aspects of this invention are illustrated in the accompanying drawings, and are more fully described in the following specification.

DETAILED DESCRIPTION OF THE DRAWINGS

Figure 1:
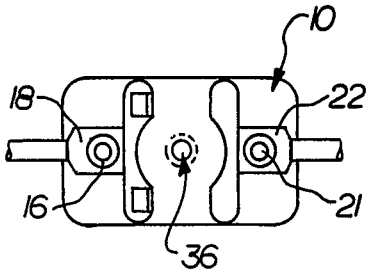
FIG. 1 is a plan view of a thermostat incorporating the present invention.

The present invention is illustrated as applied to a thermostat operated by a bimetal snap disc. It should be understood, however, that the invention may also be applicable to devices which are not, strictly speaking, thermostats, such as motor overload controls or the like, and that it may also be applied to other forms of condition sensing actuators.

The invention, however, finds particular utility applied to a device of the type illustrated, which incorporates a bimetal snap disc switch arrangement essentially as described in the U.S. Pat. No. 3,322,920 to Morris, supra. Such patent is incorporated herein by reference in its entirety.

The device provides a body 10 having a generally rectangular shape and providing a main wall 11 and laterally extending sidewalls 12 which cooperate to define a cavity in which the switch mechansim 13 and bimetal snap disc 14 are located. The switch includes a rivet 16 providing at its inner end a fixed contact 17 and connecting at its outer end to a terminal 18. A resilient movable contact support arm 19 is secured to the body 10 by a second rivet 21, which in turn connects the movable contact support arm 19 to a second terminal 22. Mounted on the free end of the support arm 19 is a movable contact 23 which is movable between a switch-closed position illustrated in FIG. 2, in which it engages the fixed contact 17 and a switch-open position illustrated in FIGS. 4 through 6, in which the two contacts are separated from each other.

The bimetal snap disc 14 is formed with a shallow curvature and is structured so that it snaps back and forth between two positions of stability with snap action in response to predetermined temperatures. The disc form is arranged so that once in the reset position of stability of FIG. 2, it will remain in such position until the disc reaches a predetermined operating temperature, for example, 140° C. Once such temperature is reached, the disc will snap through to its opposite position of stability illustrated in FIG. 4, and remain in such position until manually reset, as discussed below. In practice, the disc is formed so that the temperature at which it would automatically snap back through to its reset position is a temperature which will not be encountered in the environment in which the device is intended to be used. For example, the reset temperature of the disc might be selected at 0° F. In practice, the disc will remain in its operative position once it is snapped through to such position until it is forcibly moved to its reset position by the manual reset mechanism.

The snap disc 14 in this embodiment is circular and is laterally located within the device by four projections 26, 27, 28, and 29 molded into the body 10. The disc is held in a trapped position adjacent to the main wall 11 by the movable contact arm which extends across the disc on the side thereof remote from the wall 11. It should be understood that the snap disc 14 may, in some instances, be non-circular and the term "disc" as used herein is not limited to circular discs.

When the snap disc 14 is in its reset position illustrated in FIG. 1, one edge 31 is trapped between the movable contact support art 19 and the main wall 11 and the opposite, or operating edge 32 is located adjacent to the movable contact support arm at a location substantially adjacent to the movable contact 23. The center portion 33 of the disc is located between the projecting end 34 of manual reset member 36 which provides a reduced diameter shank portion 37 extending through a mating opening 38 in the body 10. The inner end of the manual reset member is provided with an enlarged head 39 which is generally spherical in shape and provides the projection 34. The head 39 is positioned within a shallow recess formed in the body and provides mating surfaces with the wall 11 which limit the movement of the manual reset member in a direction to the left as viewed in the drawings to the position illustrated in FIGS. 2 and 4.

While the snap disc 14 remains in its reset position or condition, it is loosely trapped between the projection 34 and the movable contact support arm 19, and does not exert any force on such arm in the contact opening direction. The movable contact support arm is formed of resilient material and is shaped to maintain the movable contact 23 in engagement with the fixed contact 17 so long as the disc remains in the reset position and the manual reset member is not pressed to the right.

Figure 4:
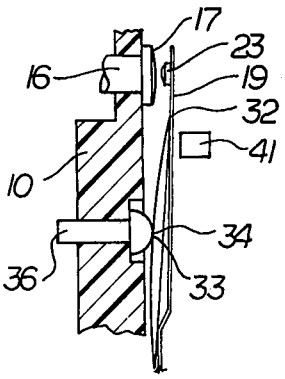
FIG. 4 is a schematic view, illustrating the position of the elements after the disc is operated.

When the bimetal snap disc 14 reaches its operating temperature and snaps through to its operative position, its curvature is reversed to the condition of FIG. 4 and the operating edge 32 of the disc engages the underside of the contact support arm 19, moving it to the right as viewed in the drawing, to the switch-open position of FIG. 4. This interrupts the electrical circuit between the two terminals 18 and 22. As mentioned above, the disc remains in that position until it is manually reset.

The body 10 is provided with a pair of lateral projections 41, with one located on each side of the movable contact arm substantially adjacent to the operating edge 32 of the disc. These projections serve as fixed stops against which the disc is pressed during the manual reset operation.

Figure 5:
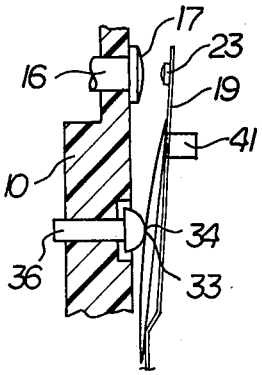
FIG. 5 is a schematic view similar to FIG. 4, illustrating the position the elements assume when the manual reset member has been operated to move the disc into engagement with the fixed stops.
Figure 6:
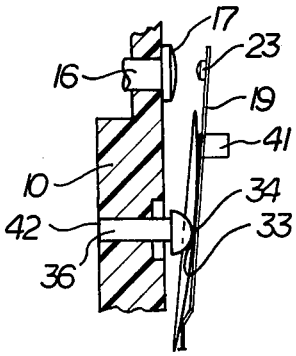
FIG. 6 is a schematic view similar to FIGS. 4 and 5, but illustrating the position of the elements at the completion of the manual reset operation, but before the manual reset member is released.

When it is desired to manually reset the disc 14, the manual reset member 36 is pressed to the right as viewed in FIGS. 2, 4, 5, and 6. During the initial travel of the manual reset, the disc is caused to pivot about its edge 31 to an intermediate position illustrated in FIG. 5 in which the edges of the disc engage the fixed stops or projections 41, as illustrated in FIG. 5. This movement is in a contact-opening direction and causes the movable contact 22 to move even further away from the fixed contact 17. Once the disc reaches the position of FIG. 5, it cannot pivot any further, so the continued movement of the manual reset member 36 to the right pushes the disc through to its reset position, as illustrated in FIG. 6.

The resetting force is applied to the center portion 33 of the disc and is resisted by the fixed stops 41 and the engagement between the edge 31 and the movable contact support arm 19. It should be noted from FIG. 6, however, that even though the disc has been moved to its reset condition, the contact 23 is spaced substantially from the fixed contact 17 and the switch remains open.

Figure 2:
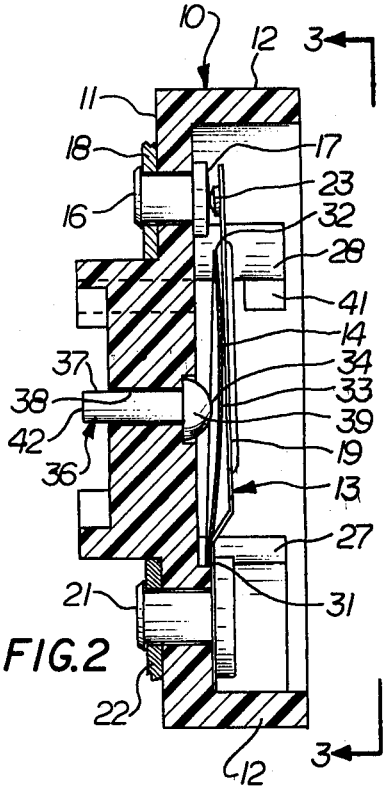
FIG. 2 is an enlarged longitudinal section.
Figure 3:
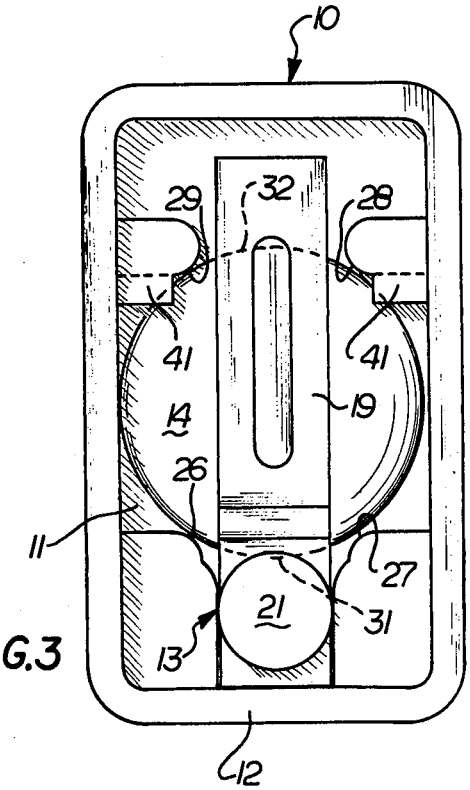
FIG. 3 is an enlarged view taken from the side of the device opposite the side illustrated in FIG. 1.

In the event that the disc temperature has dropped below the operating temperature, the disc will remain in the reset position and as the manual reset member 36 is released, the resiliency of the movable contact support arm will cause the elements to move to the switch-closed position of FIG. 2, completing the resetting operation. On the other hand, if the disc remains above its operating temperature when the manual resetting is attempted, the disc will snap back to its operative position of FIG. 5 as the force on the manual reset member is released, and the release of the manual reset member 36 will cause the disc to assume the operative position of FIG. 5, to maintain the switch in the contact-open position. Therefore, when full release of the manual reset member 36 occurs, the elements return to the position of FIG. 4 and the switch remains open. Consequently, with this invention, the manual reset operation is trip-free in that it cannot cause switch closure unless the bimetal snap disc 14 has returned to a temperature below its operating temperature.

to prevent overstressing of the disc, the shank portion 37 of the manual reset member 36 is sized to have a length so that the end 42 thereof is flush with the adjacent portions of the main wall 11 when the disc is reset. Further, the diameter of the shank portion is small so that the manual reset cannot normally be pressed beyond the position of FIG. 6, so damage to the disc or the resilient movable contact support arm does not occur.

With this invention, trip-free operation is achieved with a very minimal modification of the basic structure of the device. It is merely necessary to provide fixed stops 41 which engage the disc at an intermediate point and support the disc so that additional travel of the manual reset member will produce the resetting of the disc. Further, because the force of resetting is applied in the direction of switch opening, it is not necessary to form the parts of the device with very close tolerances; it is merely necessary to locate the fixed stops 41 so that they do not engage the disc during normal operation but are sufficiently close so that the movable contact arm is not overstressed during the manual reset operation.

Although the preferred embodiment of this invention has been shown and described, it should be understood that various modifications and rearrangements of the parts may be resorted to without departing from the scope of the invention as disclosed and claimed herein.

What is claimed is:

1. A trip-free manual reset snap discoperated condition sensing device comprising a body assembly, a switch on said body assembly including a fixed contact and a movable contact, said movable contact being movable in a first direction from a switch-closed position in engagement with said fixed contact to a switch-open position spaced from said fixed contact, a snap disc in said body movable with snap action from a reset position to an operative position in response to a predetermined condition, said snap disc being operatively connected to said movable contact and operating to move said movable contact to said switch-open position in response to movement of said snap disc to said operative position, and a manual reset member mounted on said body assembly and providing a user accessible portion which is moved by such user in said first direction to reset said disc, said reset member when operated applying a resetting force in said first direction to said snap disc to move said snap disc to said reset position and also cause said snap disc to maintain said movable contact in said switch-open position so long as said resetting force is applied, release of said manual reset members allowing said movable contact to move to said switch-closed position only when said snap disc remains in said reset position.

2. A trip-free reset device as set forth in claim 1, wherein said body assembly includes stops operable to limit movement of a portion of said disc remote from said reset in said one direction.

3. A trip-free reset device as set forth in claim 2, wherein said disc is formed of bimetal and moves to its operative position when it reaches a predetermined temperature.

4. A trip-free manual reset bimetal snap disc-operated device comprising a body assembly, a switch on said body assembly including a movable contact movable in a first direction from a switch-closed position to a switch-open position, a bimetal snap disc on said body movable with snap action in response to a first temperature condition from a reset position to an operative position and remaining in said operative position until manually reset, said disc providing a first edge portion and a center portion which are supported in fixed positions when it snaps to said operative position causing an opposite edge portion to move in said first direction and causing said opposite edge portion to move said movable contact to said switch-open position, stop means on said body assembly operable to limit movement of said opposite edge of said disc in said first direction beyond a predetermined position, and a manual reset member operable to engage and move the central portion of said snap disc in said one direction to reset said snap disc while causing said snap disc to maintain said movable contact in said open position.

5. A trip-free reset device as set forth in claim 4, wherein said manual reset member is structured to limit its movement in said one direction to prevent overstressing of said disc.

6. A trip-free reset device as set forth in claim 5, wherein said movable contact is cantilever-mounted on a resilient movable contact support arm, and said stop means are located to allow full resetting of said disc without overstressing said support arm.

7. A trip-free reset device as set forth in claim 6, wherein said stop means are spaced from said disc except when said reset is operated.

8. A trip-free reset device as set forth in claim 4, wherein said reset member positions said center portion of said disc in said fixed position when it snaps to said operative position.

* * * * *